US008118378B2

(12) United States Patent
Wei et al.

(10) Patent No.: US 8,118,378 B2
(45) Date of Patent: Feb. 21, 2012

(54) RAIL ASSEMBLY

(75) Inventors: Chih-Wei Wei, Taipei County (TW); Jui-Lien Yang, Taipei County (TW)

(73) Assignee: Li-Mei LIN, Taipei ( * ) Notice: Subject to any disclaimer, the term of this patent is extended or adjusted under 35 U.S.C. 154(b) by 0 days.

(21) Appl. No.: 12/905,111

(22) Filed: Oct. 15, 2010

(65) Prior Publication Data

US 2011/0033140 A1 Feb. 10, 2011

Related U.S. Application Data

(63) Continuation of application No. 11/590,473, filed on Nov. 1, 2006, now abandoned.

(51) Int. Cl.
*A47B 88/04* (2006.01)

(52) U.S. Cl. ..... 312/333; 312/319.1

(58) Field of Classification Search ..... 312/330.1, 312/333, 334.1, 334.7, 334.8, 334.44, 334.46, 312/334.47, 334.11, 319.1; 384/18, 19, 20, 21, 22

See application file for complete search history.

(56) References Cited

U.S. PATENT DOCUMENTS

| | | | | |
|---|---|---|---|---|
| 6,652,050 | B2 * | 11/2003 | Lin | 312/333 |
| 6,979,066 | B2 * | 12/2005 | Yang | 312/333 |
| 7,244,005 | B1 * | 7/2007 | Lu | 312/333 |
| 2005/0093406 | A1 * | 5/2005 | Yang | 312/333 |

* cited by examiner

*Primary Examiner* — James O Hansen

(57) ABSTRACT

A rail assembly includes an outer rail, a middle rail, an inner rail, and a retrieving unit. The outer rail has an outer rail space for accommodating the middle rail, the inner rail, and the retrieving unit. The middle rail slides in the outer rail space and has a middle rail space for accommodating the inner rail. The inner rail is accommodated in the middle rail and slides in the middle rail space. The retrieving unit is assembled on one end of the outer rail space.

5 Claims, 7 Drawing Sheets

RAIL ASSEMBLY

CROSS-REFERENCE TO RELATED APPLICATION

This application is a Continuation-in-part application of Ser. No. 11/590,473, filed 1 Nov. 2006, and entitled "AUTO-RETURNING TRACK DEVICE", now pending.

BACKGROUND OF THE INVENTION

1. Field of the Invention

The present invention relates to a rail assembly, which has a desirable overall telescoped length of a rail assembly, stable structure, and strong strength.

2. Description of Related Art

A first conventional returnable rail device is illustrated in FIG. 10. An outer rail 70 has a T-shaped fixed unit 71 disposed on one end thereof such that the end of the outer rail 70 is enclosed. The fixed unit 71 has a slot 76 defined in a middle T-shaped stub thereof. Two sliding rails 77 are respectively disposed on two sides of the slot 76 and are parallel to the outer rail 70. The sliding rail 77 has a buckling groove 771 disposed on a front end thereof. A movable unit 72 and a buckling unit 721 disposed in the slot 76 in the T-shaped stub. The movable unit 72 has two columns 73 disposed on the two sliding rails 77 such that the movable unit 72 slides in the sliding rails 77. Two elastic units 74 are respectively mounted between the two columns 73 and the T-shaped unit 71. The buckling unit 721 is connected to the movable unit 72. The buckling unit 721 has a connecting portion defined in a top thereof. A guiding part 751 is disposed in the inner rail 75 for corresponding to the connecting portion of the buckling unit 721. When the inner rail 75 is pulled outwardly, the guiding part 751 drives the movable unit 72 moved along the sliding rail 77 to the buckling groove 771. The buckling unit 721 is fixed in the buckling groove 771 temporarily. The guiding part 751 is detached from the buckling unit 721. Conversely, when the inner rail 75 is pushed into the outer rail 70, the inner rail 75 is returned. When the guiding part 751 is contacted with the connecting portion of the buckling unit 721, the buckling unit 721 is detached from the buckling groove 771 of the sliding rail 77. The inner rail 75 is auto-returned due to an elastic force of the elastic units 74.

A second conventional returnable rail device is illustrated in FIG. 11. An outer rail 80 has a T-shaped fixed unit 81 disposed on one end thereof such that the end of the outer rail 80 is enclosed. The fixed unit 81 has a sliding rail 87 defined in a top thereof. A buckling groove 871 is defined in a front end of the sliding rail 87. A movable buckling unit 83 is mounted in the sliding rail 87. The movable buckling unit 83 has a connecting groove 831 defined therein. The movable buckling unit 83 has two buckling columns disposed on a bottom thereof for receiving in the sliding rail 87. The movable buckling unit 83 is able to slide in the sliding rail 87. An elastic unit 82 is disposed between the movable buckling unit 83 and the T-shaped fixed unit 81. A guiding part 841 is disposed on the inner rail 84 for corresponding to the connecting groove 831 of the movable buckling unit 83. When the inner rail 84 is outwardly pulled, the guiding part 841 drives the movable buckling unit 83 moved along the sliding rail 87 to the buckling groove 871. The movable buckling unit 83 is fixed in the buckling groove 871 temporarily. The guiding part 841 is detached from the movable buckling unit 83. The inner rail 84 is outwardly pulled. Conversely, the inner rail 84 is pushed into the outer rail 80. When the guiding part 841 is contacted with the connecting groove 831, the movable buckling unit 83 is detached from the buckling groove 871. The inner rail 84 is auto-returned due to an elastic force of the elastic unit 82.

A third conventional returnable rail device is illustrated in FIG. 12. An outer rail 90 has a fixed unit 91 disposed on one end thereof such that the end of the outer rail 90 is enclosed. The fixed unit 91 has two sliding rails 92 respectively defined in two sided slots of the outer rail 90. A movable buckling unit 93 is mounted in the sliding rails 92. The movable buckling unit 93 has two columns 932 formed on two sides thereof. The two columns 932 are mounted in the sliding rails 92 such that the movable buckling unit 93 is able to slide in the sliding rail 92. The sliding rail 92 has a buckling groove 971 defined in a front end thereof. The movable buckling unit 93 has an elastic unit 94 mounted between the two columns 932. The movable buckling unit 93 has a connecting portion formed on a top thereof. The inner rail 95 has a guiding part 96 defined in an inner surface thereof for corresponding to the connecting portion of the movable buckling unit 93. When the inner rail 95 is pulled outwardly, the guiding part 96 drives the movable buckling unit 93 moved along the sliding rail 92 to the buckling groove 971. The movable buckling unit 93 is fixed in the buckling groove 971 temporarily. Conversely, the inner rail 95 is pushed into the outer rail 90. When the guiding part 96 is contacted with the connecting portion of the movable buckling unit 93, the movable buckling unit 93 is detached from the buckling groove 971. The inner rail 95 is auto-returned due to an elastic force of the elastic unit 94.

The above described three conventional returnable rail devices illustrated in FIGS. 10-12, the sliding rail is disposed in the fixed unit.

A length of the sliding rail is restricted by a length of the fixed unit. The movable unit/the movable buckling unit is mounted in the sliding rail, connected with the elastic unit, and buckled with the guiding part in the inner rail. When the inner rail is pulled outwardly, the guiding part drives the movable unit/the movable buckling unit moving along the sliding rail to the buckling groove. The movable unit/the movable buckling unit is fixed in the buckling groove temporarily. The movable unit/movable buckling unit slides in the sliding rail such that a sliding stroke of the movable unit/movable buckling unit is restricted. When a three-rails telescopic device is utilized, an outer rail is mounted with the fixed unit. When a returning stroke of the movable unit/movable buckling unit is increased, a length of the middle rail is decreased. A total length and a strength of the telescopic device is decreased.

The present invention has arisen to mitigate and/or obviate the disadvantages of the conventional returnable rail device.

SUMMARY OF THE INVENTION

The main objective of the present invention is to provide a rail assembly, which has a desirable overall telescoped length of a rail assembly, stable structure, and strong strength.

To achieve the objective, the rail assembly in accordance with the present invention includes an outer rail, a middle rail, an inner rail, and a retrieving unit. The outer rail has an outer rail space for accommodating the middle rail, the inner rail, and the retrieving unit.

The middle rail slides in the outer rail space, and has a middle rail space for accommodating the inner rail. The inner rail is accommodated in the middle rail, and sliding in the middle rail space.

The retrieving unit is assembled on one end of the outer rail space, and comprises a fixing part, disposed in the outer rail space, such that one end of the outer rail space is made into a closed end, the other end is made into an opened end; a sliding rail, be formed by two sided slots of the outer rail at the opened end; a buckling projection, disposed on the outer rail in the outer rail space at the opened end and located between the outer rail and the middle rail such that the middle rail is not obstructed by the buckling projection and extends over the buckling projection; a moving part, disposed in the outer rail space, and sliding along the sliding track; a buckling mechanism, disposed on the moving part; at least one elastic part, disposed between the fixing part and the moving part; and a guiding part, disposed on the inner rail. When the moving part slides along the sliding track, the middle rail extends over the buckling projection to increase a sliding scope and a length of the middle rail.

The moving part has two first slots and two pivoted slots. The two first slots are disposed between the moving part and the outer rail.

The buckling mechanism includes a buckling part and an elastic-plate.

The elastic-plate has a plate with two columns and a plurality of an elastic-portion. The two columns are assembled on the two first slots.

A plurality of the elastic-portion are abutted against the wall of the moving part. Two pivoted rods of the buckling part are assembled in the two pivoted slots of the moving part, and two buckling rods of the buckling part is assembled in the two first slots of the moving part and seated on the elastic-plate.

The moving part has two receiving slots on the both sides and the fixing part also has two receiving slots on the both sides or between the fixing part and the outer rail. When the moving part slides in the outer rail space, the inner rail extends through the receiving slots and reaching the closed end of the outer rail, so as to increase a sliding scope and a length of the inner rail. Such that the rail assembly has a maximum length and strength.

At least one elastic part is located on an outer side of the receiving slots.

A buffer unit comprises a buffer part and a mechanism corresponding to the buffer part, and the buffer part generates a buffering function through the corresponding mechanism.

Further benefits and advantages of the present invention will become apparent after a careful reading of the detailed description with appropriate reference to the accompanying drawings.

DETAILED DESCRIPTION OF THE INVENTION

Figure 1:
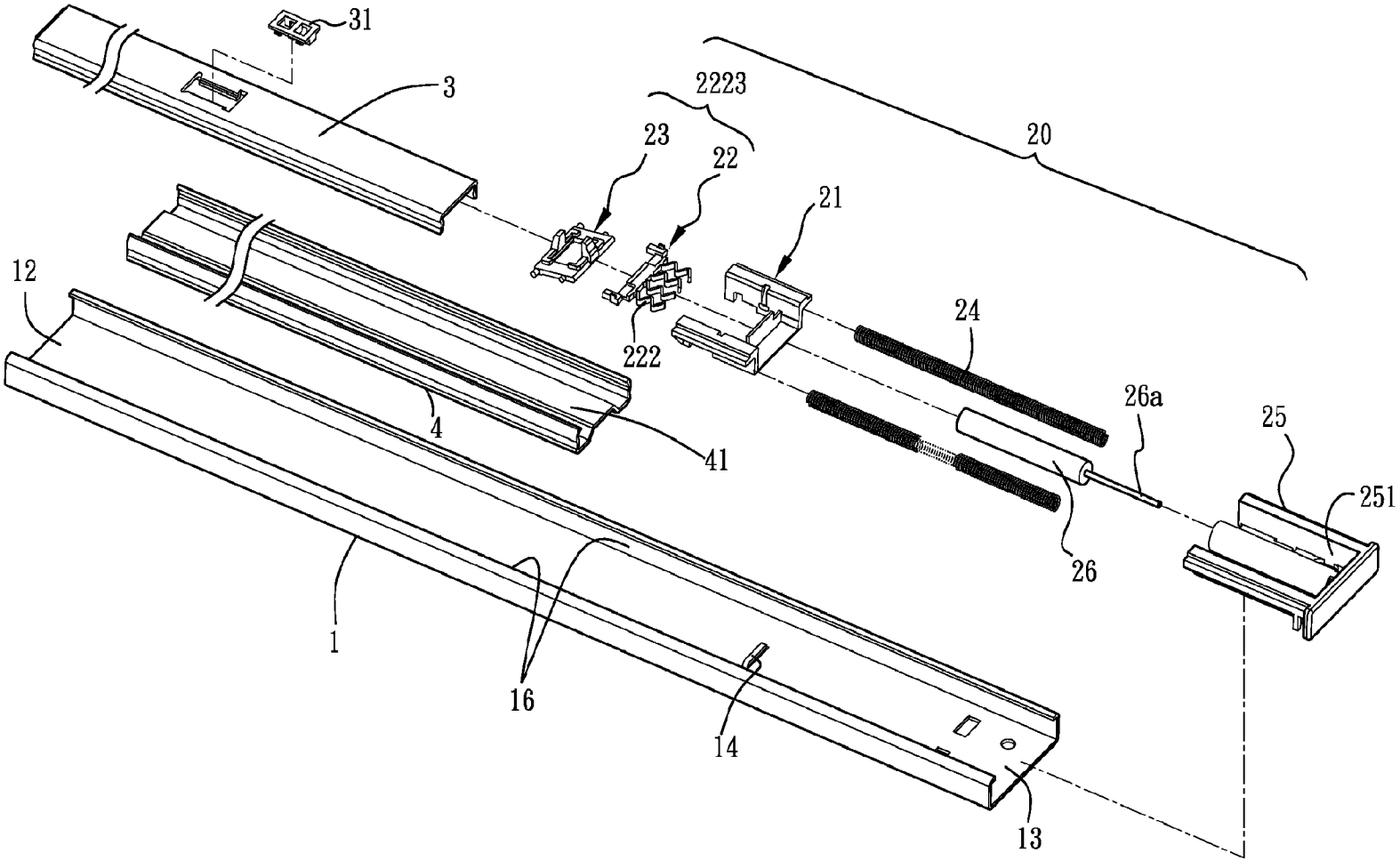
FIG. 1 is an exploded perspective view of a rail assembly in accordance with the present invention.
Figure 2:
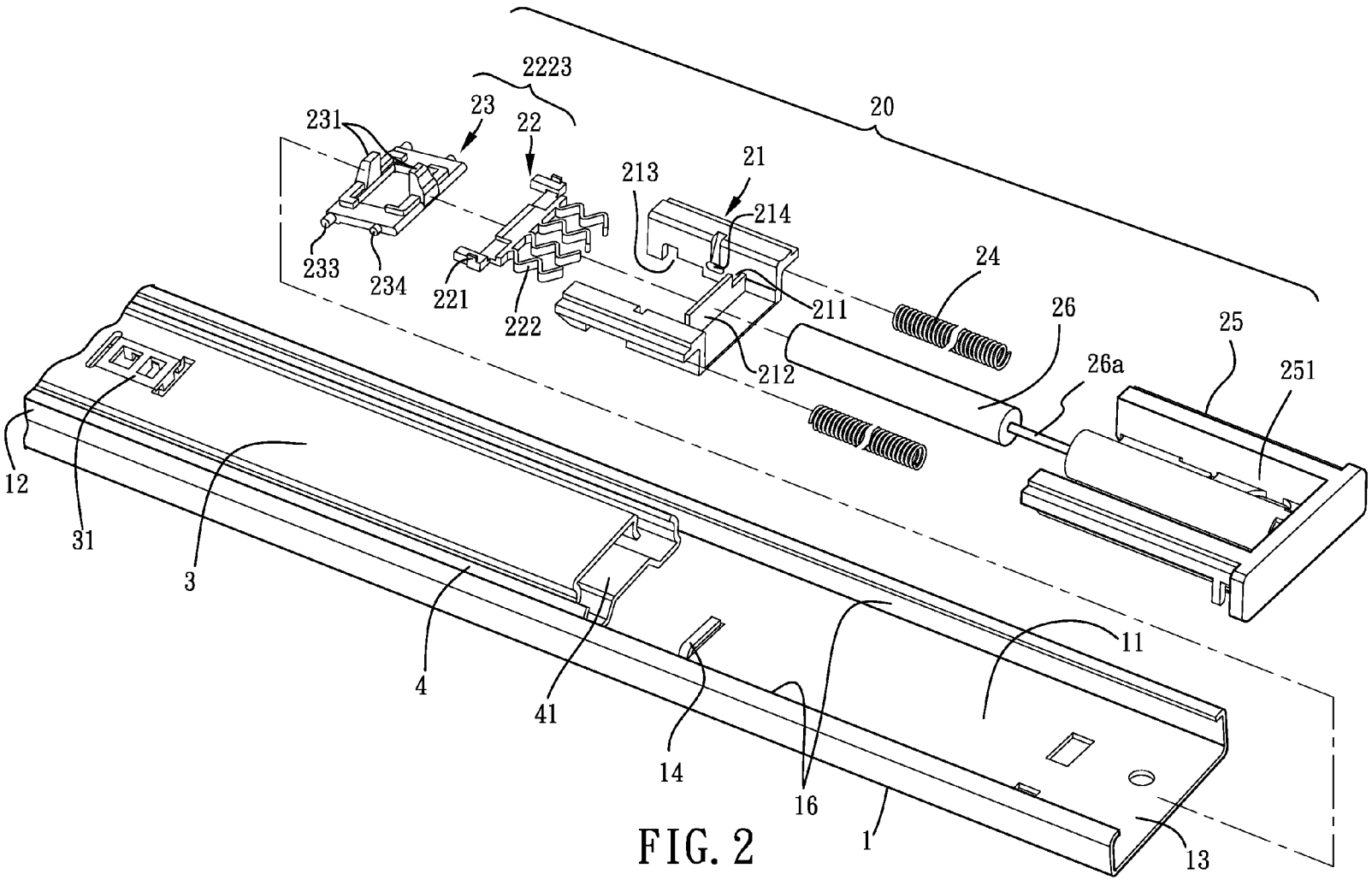
FIG. 2 is an enlarged exploded perspective view of an actuating mechanism of the rail assembly in accordance with the present invention.
Figure 3:
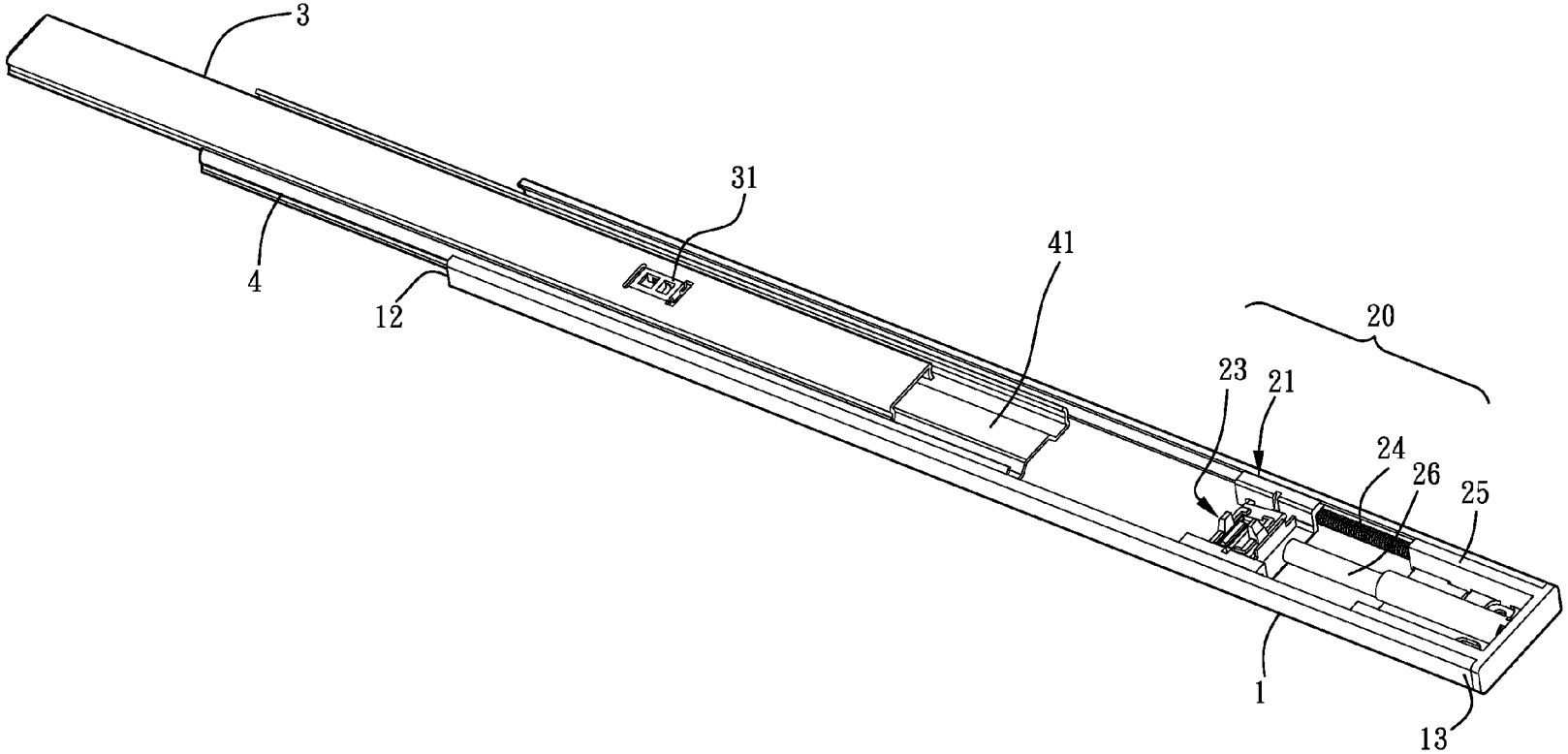
FIG. 3 is an assembled perspective view of the rail assembly in accordance with the present invention.
Figure 4:
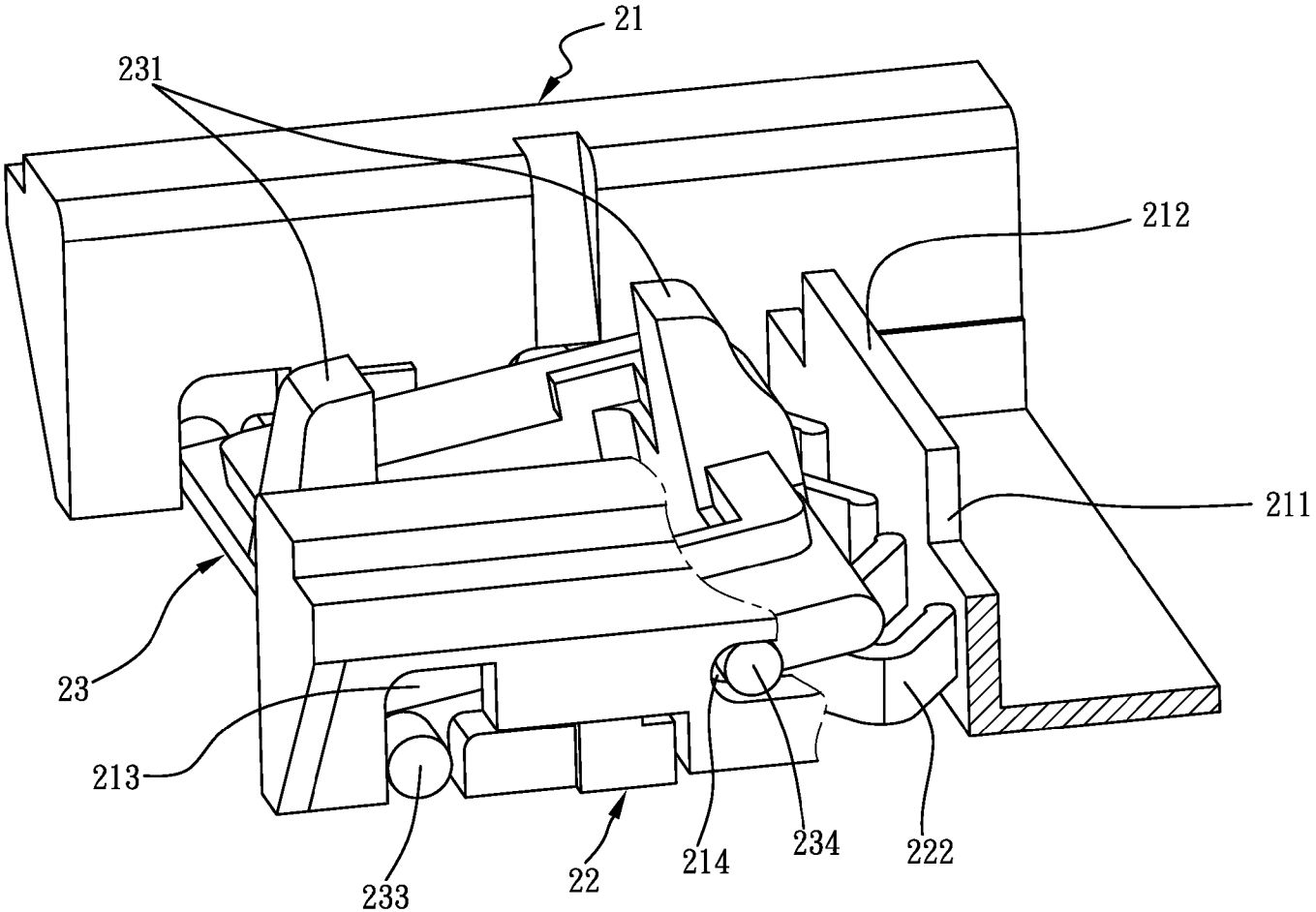
FIG. 4 is an enlarged assembled perspective view of a moving part and a buckling mechanism.

Referring to the drawings and initially to FIGS. 1-4, a rail assembly in accordance with the present invention comprises an outer rail 1, a middle rail 4, an inner rail 3, and a retrieving unit 20.

The outer rail 1 has an outer rail space 11 for accommodating the middle rail 4, the inner rail 3, and the retrieving unit 20. The middle rail 4 extends in the outer rail space 11, and has a middle rail space 41 capable of accommodating the inner rail 3. The inner rail 3 is accommodated in the middle rail 4, and extends in the middle rail space 41. The retrieving unit 20 is assembled on one end of the outer rail space 11, and comprises: a fixing part 25, disposed in the outer rail space 11, such that one end of the outer rail space 11 is made into a closed end 13, and the other end is an opened end 12; a sliding rail 16, disposed on the outer rail 1 in the opened end 12 of the outer rail space 11; a buckling projection 14, disposed on the outer rail 1 in the outer rail space 11 at the opened end and located between the outer rail 1 and the middle rail 3, such that the middle rail 3 is not obstructed by the buckling projection 14; a moving part 21, disposed in the outer rail space 11 and sliding along the sliding rail 16, in which the moving part 21 slides in the outer rail 11 through the sliding rail 16, the moving part 21 have two first slots 213, two pivoted slots 214, and a wall 212; on the top of the moving part 21 having two receiving slots 211 defined therein; a buckling mechanism 2223 includes an elastic plate 22 and a buckling part 23, the elastic plate 22 disposed between the two first slots 213 defined in the bottom of the moving part 21 and the outer rail 1, at a front end of the elastic plate 22 having a plurality of the elastic portion 222 which make the elastic plate 22 into compressibility, and a rear end of the elastic plate 22 having a plate with two columns 221; at a front end of the buckling part 23 having two pivoted rods 234 which be disposed on the two pivoted slots 213, and a rear end of the buckling part 23 be seated on the elastic plate 22, such that the buckling part 23 be swinging at the two pivoted slots 213 and corresponding to the buckling projection 14; the buckling part 23 also having two connecting blocks 231 defined in a top thereof; a guiding part 31, disposed on the inner rail 3 for corresponding to the two connecting blocks 231; at least one elastic part 24, disposed between the fixing part 25 and the moving part 21.

Figure 5:
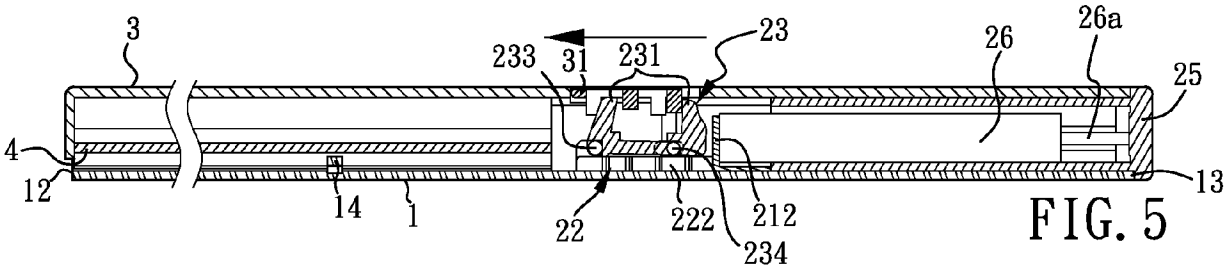
FIGS. 5-9 are side plane operational views of the rail assembly in accordance with the present invention.
Figure 6:
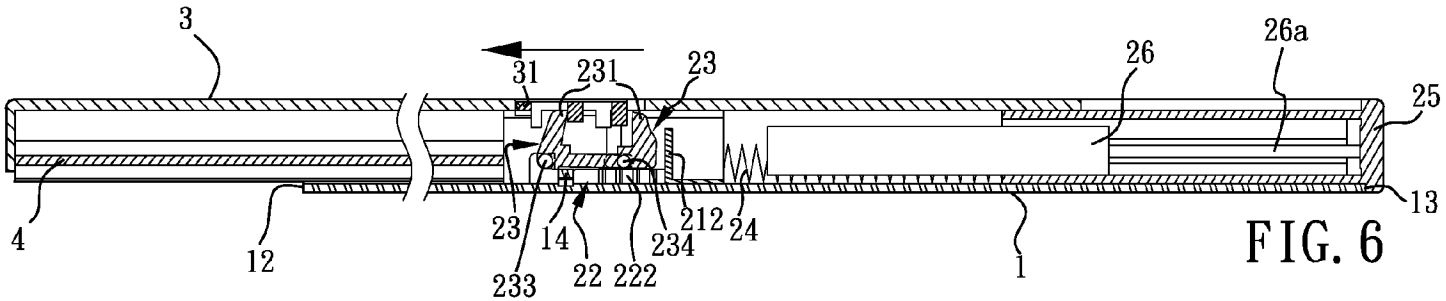
Figure 7:
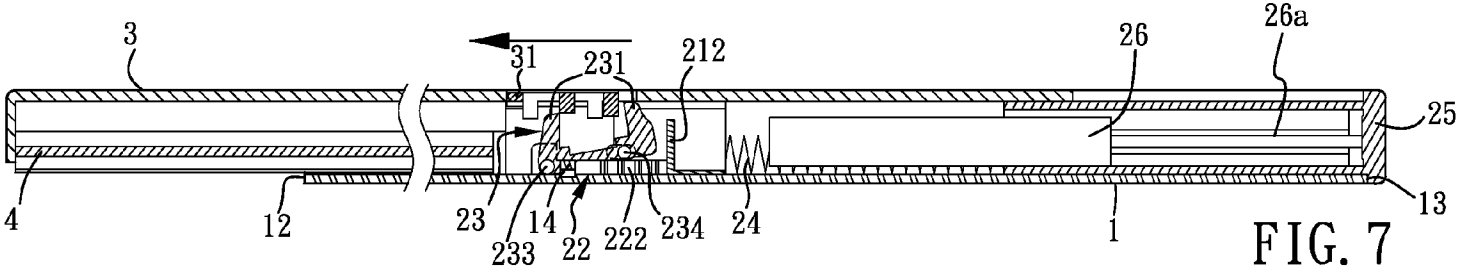
Figure 8:
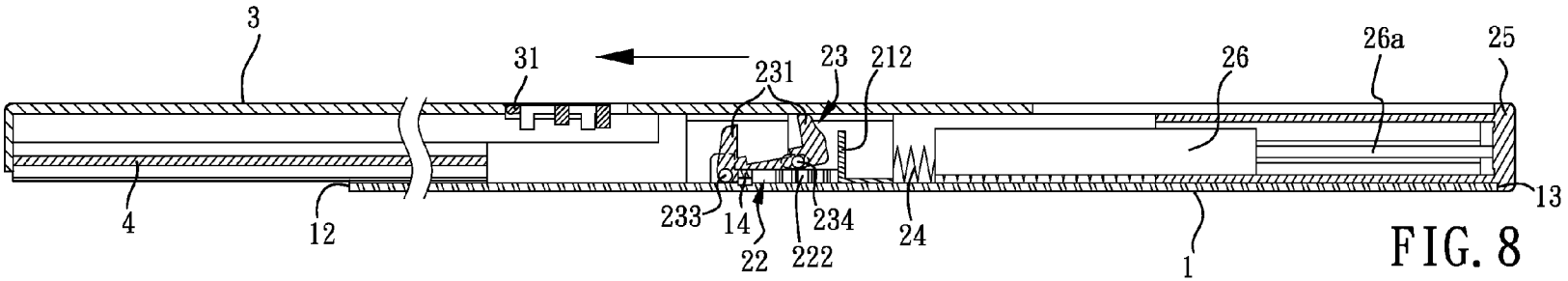
Figure 9:
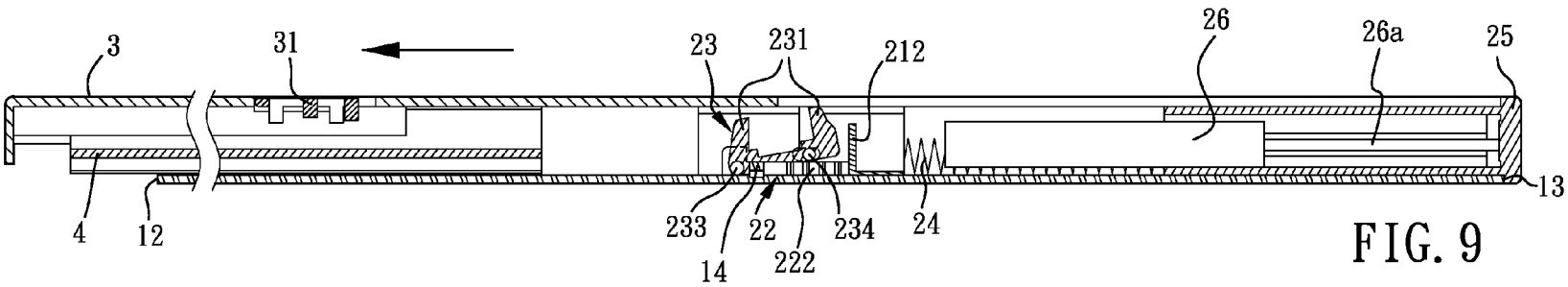
Figure 10:
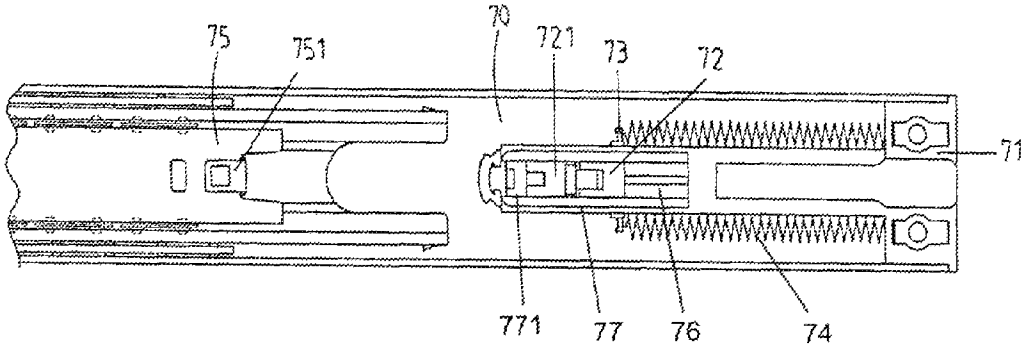
FIG. 10 Prior Art
FIGS. 10-12 are conventional track devices in accordance with the prior arts.
Figure 11:
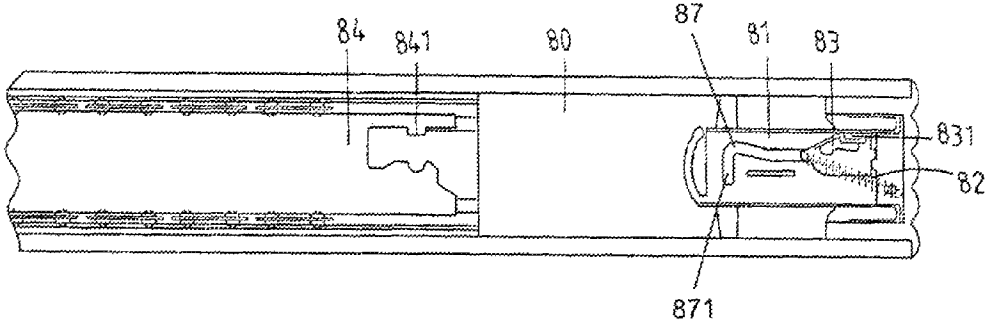
FIG. 11 Prior Art
Figure 12:
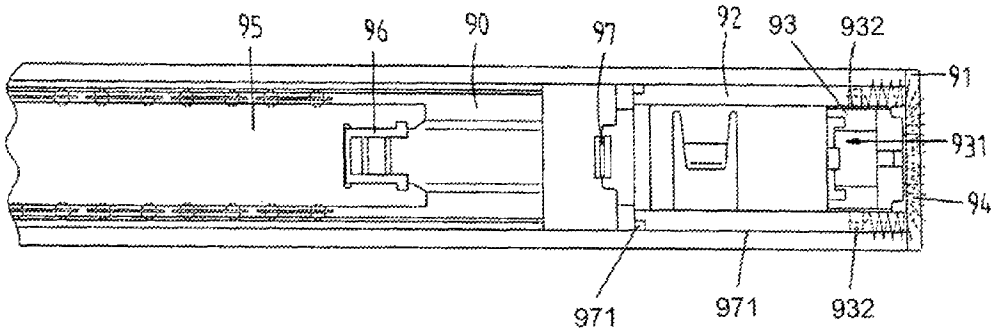
FIG. 12 Prior Art

Referring to FIGS. 5-9, when the inner rail 3 is returned, the guiding part 31 is buckled with the buckling mechanism 2223. When the rail is pulled outwardly, the guiding part 31 drives the moving part 21 moving along the sliding rail 16. When the elastic plate 22 of the buckling mechanism 2223 is abutted against the buckling projection 14, the elastic plate 22 is compressed. The buckling rods 233 of the buckling part 23 detached from the elastic plate 22 and buckled with the buckling projection 14. The moving part 21 is fixed on the buckling projection 14 temporarily. Conversely, when the inner rail 3 is inwardly pushed, the guiding part 31 is abutted against the two connecting blocks 231 of the buckling part 23 to detach from the buckling projection 14, such that the buckling part 23 be seated on the elastic plate 22. The middle rail 4 is not obstructed by the buckling projection 14 and extends over it to increase a sliding scope and length of the middle rail 4.

As shown in FIGS. 5-9, in the outer rail space 11, two receiving slots 211, 251 are respectively disposed on two sides of the moving part 21 and the fixing part 21 or two receiving slots 251 are disposed between the fixing part 25 and the outer rail 1, in which when the inner rail 3 extends through the receiving slots 211, 251 in the outer rail space 11 and reaches the closed end 13 of the outer rail 1, such that a length of the inner rail 3 is the same as the outer rail 1.

As compared with the prior art, in the retrieving unit 20 of the rail assembly of the present invention, the sliding rail 16 is disposed on the outer rail 1 at the opened end 12, the moving part 21 slides along the sliding rail 16, such that the travel of the moving part 21 is not limited by the fixing part 25. The buckling projection 14 is disposed on the outer rail 1 at the opened end 12 and located between the outer rail 1 and the middle rail 3, such that the middle rail 3 is not obstructed by the buckling projection 14 and effectively extends into the outer rail space 11 and close to the closed end 13 of the outer rail 1. Furthermore, with the receiving slots 211, 251 designed on the retrieving unit 20, the inner rail 3 can also be shrunk to the closed end 13 of the outer rail 1.

The outer rail 1 has better accommodation features, so that the lengths of the middle rail 4 and the inner rail 3 can be increased. Thus, when the structure of the present invention is telescoped, it has a better total length, and the overall telescope ratio is increased. In the present invention, a buffer part 26 is further disposed, and the buffer part 26 and the retrieving unit 20 may be disposed on the same end or different ends of the outer rail 1. The buffer unit comprises a buffer part 26 and a mechanism corresponding to the buffer part 26, and the buffer part 26 generating a buffering function through the corresponding mechanism.

The buffer part 26 and the corresponding mechanism are connected together. Through the buffering function provided by the buffer part 26, a shrinking speed of the elastic part 22 may be tempered. The buckling projection 14 is located between the outer rail 1 and the middle rail 4, such that the middle rail 4 is not obstructed by the buckling projection 14 and effectively increases the sliding scope of the middle rail 4.

Thus, a longer middle rail 4 may be adopted, such that the rail assembly has a better overall telescoped length.

Although the invention has been explained in relation to its preferred embodiment, it is to be understood that many other possible modifications and variations can be made without departing from the spirit and scope of the invention as hereinafter claimed.

What is claimed is:

1. A rail assembly, comprising:

an outer rail, a middle rail, an inner rail, and a retrieving unit, wherein the outer rail has an outer rail space for accommodating the middle rail, the inner rail and the retrieving unit; the middle rail slides in the outer rail space, and has a middle rail space for accommodating the inner rail; the inner rail accommodated in the middle rail, and sliding in the middle rail space; and the retrieving unit assembled on one end of the outer rail space, and comprises:

a fixing part, disposed in the outer rail space, such that one end of the outer rail space is made into a closed end, the other end is made into an opened end;

a sliding rail, disposed on the outer rail at the opened end;

a moving part, disposed in the outer rail space, and sliding along the sliding rail;

a buckling mechanism, disposed on the moving part;

at least one elastic part, disposed between the fixing part and the moving part; and a guiding part, disposed on the inner rail and corresponding to the buckling mechanism;

wherein the moving part slides along the sliding rail in the outer rail space at the opened end, the movement of the moving part are not restricted by a length of the fixing part;

wherein in the outer rail space, the moving part has two receiving slots on the both sides and the fixing part also has the two receiving slots on the both sides or between the fixing part and the outer rail; wherein when the moving part slides in the outer rail space, the inner rail extends through the receiving slots and closes to the closed end of the outer rail, so as to increase a sliding scope and a length of the inner rail; the rail assembly has a maximum length and strength.

2. The rail assembly as claimed in claim 1, wherein a buckling projection disposed on the outer rail in the outer rail space at the opened end as desirability and located between the outer rail and the middle rail such that the middle rail is not obstructed by the buckling projection and extends over the buckling projection; wherein when the moving part slides along the sliding rail, the middle rail extends over the buckling projection to increase a sliding scope and a length of the middle rail.

3. The rail assembly as claimed in claim 1, wherein the moving part has two first slots and two pivoted slots, the first slots disposed between the moving part and the outer rail, the buckling mechanism including an elastic-plate and a buckling part, the elastic-plate having a plate with two columns and a plurality of an elastic portion, the two columns assembled on the first slots of the moving part and the plurality of the elastic portion abutted against the wall of the moving part; one end of the buckling part have two pivoted rods be assembled in the pivoted slots of the moving part, and the other end of the buckling part have two buckling rods be assembled in the first slots of the moving part and seated on the elastic-plate, such that the buckling part swings at the pivoted slots and the buckling mechanism corresponds to the buckling projection.

4. The rail assembly as claimed in claim 3, wherein the moving part is fixed on the buckling projection via the buckling mechanism temporarily.

5. The rail assembly as claimed in claim 1, wherein the elastic part is located on an outer side of the receiving slots.

* * * * *